US012612859B2

(12) United States Patent
Wang et al.

(10) Patent No.: US 12,612,859 B2
(45) **Date of Patent: *Apr. 28, 2026**

(54) SYSTEMS AND APPARATUS FOR DOWNHOLE COMMUNICATION

(71) Applicant: Well Resolutions Technology, Houston, TX (US)

(72) Inventors: Tsili Wang, Houston, TX (US); Borislav J. Tchakarov, Houston, TX (US)

(73) Assignee: Well Resolutions Technology, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/823,241

(22) Filed: Sep. 3, 2024

(65) Prior Publication Data

US 2024/0418080 A1 Dec. 19, 2024

Related U.S. Application Data

(63) Continuation of application No. 18/135,928, filed on Apr. 18, 2023, now Pat. No. 12,078,057.

(51) Int. Cl.
*E21B 47/13* (2012.01)
*E21B 47/12* (2012.01)

(52) U.S. Cl.
CPC ..... *E21B 47/13* (2020.05); *E21B 47/138* (2020.05)

(58) Field of Classification Search
CPC ..... E21B 47/13; E21B 47/138
See application file for complete search history.

(56) References Cited

U.S. PATENT DOCUMENTS

| | | | | |
|---|---|---|---|---|
| 3,905,010 | A | 9/1975 | Fitzpatrick | |
| 4,696,631 | A | 9/1987 | Nitt | |
| 5,142,128 | A | 8/1992 | Perkin | |
| 6,885,308 | B2 | 4/2005 | Smith | |
| 7,014,100 | B2 | 3/2006 | Zierolf | |
| 7,159,654 | B2 | 1/2007 | Ellison | |
| 2005/0194134 | A1 | 9/2005 | McGregor | |
| 2005/0269083 | A1 | 12/2005 | Burris | |
| 2006/0243487 | A1* | 11/2006 | Turner | E21B 17/1014 175/26 |
| 2007/0023185 | A1 | 2/2007 | Hall | |
| 2007/0145129 | A1 | 6/2007 | Perkin | |
| 2007/0199989 | A1 | 8/2007 | Piety | |
| 2007/0285275 | A1 | 12/2007 | Purkis | |

(Continued)

FOREIGN PATENT DOCUMENTS

| | | | |
|---|---|---|---|
| CN | 103089249 | A | 5/2013 |
| WO | 2022241421 | A1 | 11/2022 |

OTHER PUBLICATIONS

Notification Concerning Transmittal of International Preliminary Report on Patentability issued in PCT/US2024/025158, mailed Oct. 30, 2025, 7 pages.

(Continued)

*Primary Examiner* — Amine Benlagsir
(74) *Attorney, Agent, or Firm* — HUNTON ANDREWS KURTH LLP

(57) ABSTRACT

The present embodiments disclose a downhole communication technology involving slotted collar allowing electromagnetic waves to reach inserted probe receiver assembly. One embodiment shows transmitter/receiver as part of At Bit tool.

9 Claims, 14 Drawing Sheets

(56) References Cited

U.S. PATENT DOCUMENTS

| | | | | |
|---|---|---|---|---|
| 2008/0030365 | A1 | 2/2008 | Fripp | |
| 2011/0018735 | A1* | 1/2011 | Garcia-Osuna | G01V 11/002 340/854.4 |
| 2011/0074427 | A1 | 3/2011 | Wang et al. | |
| 2011/0084697 | A1 | 4/2011 | Wisler et al. | |
| 2019/0148811 | A1* | 5/2019 | Trushin | E21B 47/13 166/66 |
| 2023/0124120 | A1* | 4/2023 | Yu | E21B 44/00 175/24 |

OTHER PUBLICATIONS

Notification of Transmittal of the International Search Report and the Written Opinion of the International Searching Authority issued in PCT/US2024/025158, mailed Aug. 24, 2024, 8 pages.

* cited by examiner

Graph 800

SYSTEMS AND APPARATUS FOR DOWNHOLE COMMUNICATION

CROSS-REFERENCE TO RELATED APPLICATIONS

The present application is a continuation of U.S. Ser. No. 18/135,928 filed Apr. 18, 2023 issuing as U.S. Pat. No. 12,078,057.

FIELD OF THE DISCLOSURE

The present disclosure relates to systems for facilitating the transmission of electronic data in a down hole assembly.

BACKGROUND

Down hole assemblies or bottom hole assemblies often have sensors that collect various information about wellbores and the surrounding area, including seismic data and mineral data. Transmitting this data up the wellbore can be difficult. A wired connection such as a service bus may be used, but the wire may be exposed to pressure and movement that threatens the integrity of the connection. Furthermore, some sections of the drill string such as the motor are not hospitable to wires. Thus, a wireless connection would be a more effective option. Therefore, there is a need to provide a reliable wireless component and/or system that overcomes these deficiencies.

SUMMARY OF THE DISCLOSURE

In some aspects, the techniques described herein relate to a system for transmitting and receiving data across a bottom hole assembly, the system including: an axial transmission antenna assembly including: an upper end including an upper end connection; a lower end including a lower end connection, wherein the upper end connection and the lower end connection are configured to removably attach with at least one other axial transmission antenna assembly; a pressure housing; an antenna housing further including: an antenna shield surrounding an antenna support and an antenna coil; an electronics section further including: a transmitter electronics module; a communication module; a power supply configured to power the antenna, transmitter electronics module, and the communication module; a drill collar configured to removably attach to the axial transmission antenna assembly, wherein the collar includes: a hollow interior; and an exterior including one or more slots configured to house one or more nonconducting materials.

In some aspects, the techniques described herein relate to a system for transmitting data across a bottom hole assembly, the system including: a first drill collar configured to be attached to a first antenna assembly, wherein the first drill collar further includes a first hollow interior a second exterior including one or more slots configured to house one or more nonconducting materials; and a second drill collar configured to be attached to a second antenna assembly, wherein the second drill further includes a second hollow interior and a second exterior including one or more slots configured to house one or more nonconducting materials, In some aspects, the techniques described herein relate to a device for sending and receiving communications across a down hole assembly, the device including: a collar configured to allow insertion of a first antenna assembly, the collar including one or more slots; and one or more nonconducting materials located in the one or more slots, wherein the collar is configured to facilitate a transmission of one or more electrical voltages from the first antenna assembly to a second antenna assembly.

BRIEF DESCRIPTION OF THE DRAWINGS

In order to facilitate a fuller understanding of the present disclosure, reference is now made to the attached drawings. The drawings should not be construed as limiting the present disclosure, but are intended only to illustrate different aspects and embodiments of the disclosure.

DETAILED DESCRIPTION

Figure 1:
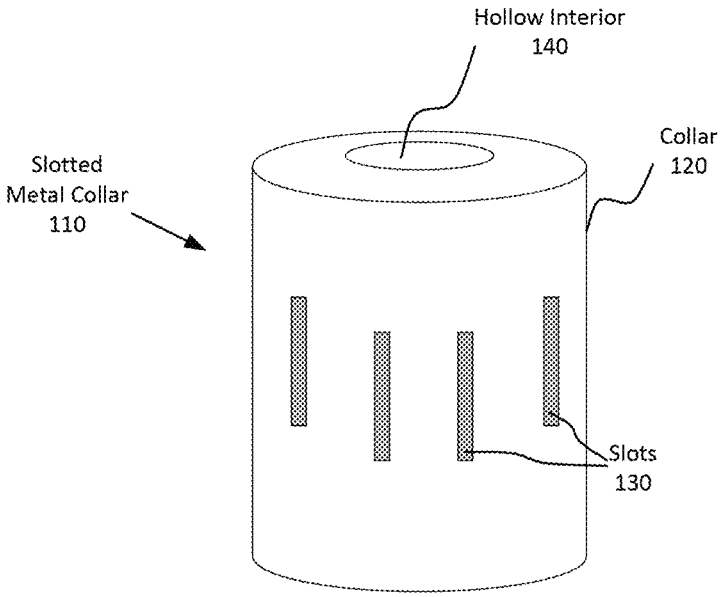
FIG. 1 is a diagram illustrating a slotted metal collar according to an exemplary embodiment.

Exemplary embodiments of the disclosure will now be described in order to illustrate various features. The embodiments described herein are not intended to be limiting as to the scope of the disclosure, but rather are intended to provide examples of the components, use, and operation that may be applicable.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The disclosure relates generally to systems and methods for communicating information between various downhole measurement sensors.

Communications is a necessary means to transfer data between various downhole measurement sensors. Such communications are especially important to transfer data between a measurement sensor and a downhole data telemetry unit for the sensor data to be transmitted uphole to surface in real time. Examples of downhole measurement sensors are resistivity, gamma ray, acoustics, neutron, density, and magnetic resonance sensors. Examples of downhole data telemetry units are mud pulser systems and electromagnetic telemetry systems. Communications between a measurement sensor themselves or between measurement sensors and a downhole data telemetry unit usually is through a wired bus, e.g., CAN, RS485, or QBus. However, in certain applications, such communications must be established through a wireless short-hop channel. An important example is across-motor communications in which sensor data generated below a mud motor must be transferred wirelessly to a data telemetry unit located above the motor because mud motors usually do not provide thru-wires for communications.

One of the most commonly used wireless short-hop communications methods employs insulated gap collars for signal transmission and reception. An insulated gap collar consists of segments of drill collars mechanically connected to each other through an electrically insulating gap. The gap servers as an electrical barrier so that no electrical current can flow from one end of the gap to the other. For transmission, an electrical voltage is applied across a transmitter collar gap, inducing an electrical current flowing through the surrounding medium. On the reception end, the electrical current produces a voltage across a receiver collar gap spaced apart from the transmitter collar gap. The voltage across the receiver gap carries information about the data being transmitted.

To detect a voltage signal across a receiver collar gap, a receiver assembly is inserted into the receiver collar gap. The receiver assembly contains a second electrical gap. The second electrical gap is aligned with the collar gap. An electrical contact is established between the upper end of the collar gap and the upper end of the receiver gap. Another electrical contact is established between the lower end of the collar gap and the lower end of the receiver gap. Such contacts may be established with metallic bow springs. Metal bow springs moveably contact the inner surface of the gap collar so that the voltage across the receiver gap will be approximately equal to that across the collar gap. The receiver assembly also contains an electronics system that detects and decodes the voltage across the receiver gap to recover the data being transmitted. One advantage of such a gap-based short-hop communications system is that the receiver assembly can be made fully moveable within the drill collar. When needed, the receiver assembly can be retrieved to the surface. Retrievability is important when a bottom-hole assembly (BHA) is stuck in hole and the downhole tools are to be recovered. One limitation of such gap-based communications system is that the collar gaps often constitute the weakest joints of a drill string. Under harsh drilling conditions, the gaps may be over-torqued, causing loss of electrical insulation, or damaged due to high levels of shock and vibration, or in the worst case even parted, causing the whole BHA below the gap to be lost in the hole.

Another commonly used wireless short-hop communications system employs coils for signal transmission and reception. Such coils and associated electronics are built in drill collars that constitute parts of a drill string for drilling operations. Compared to the aforementioned gap-based short-hop systems, a coil-based short-hop system does not contain a gap in the drill collar, thus maximally preserving drill collar integrity. Such a system may also demonstrate better signal transmission stability in highly resistive or non-conducting mud and/or formations. However, the advantages come at the expense of tool complexity and tool retrievability. Because the coils are built in a drill collar and a measurement-while-drilling (MWD) system including a data telemetry unit usually is probe based. To establish communications between the coils electronics and an MWD system, mechanical transitions are needed that are provided through flow diverters, connectors, and seals.

That is, the new short-hop communications system shall preserve the collar integrity and at the same time retain the MWD tool string retrievability.

Figure 8:
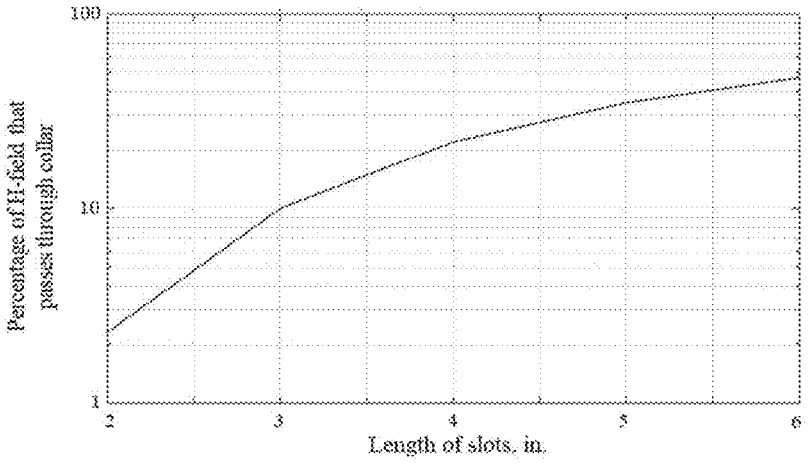
FIG. 8 is a graph illustrating a relationship between the length of slots in a collar versus the percentage of H-field that passes through the collar according to an exemplary embodiment.

FIG. 1 illustrates a slotted metal collar 110 including at least a collar 120 and one or more slots 130 The collar 120 usually is made of some sort of steel, e.g., a type of nonmagnetic steel although other suitable metals known in the art may be used. One or more slots 130 are cut into the wall of the collar 120. The slots 130 may be oriented along the longitudinal direction of the collar 120 and extend from the outer diameter of the collar 120 to the inner diameter of the collar 120. To prevent drilling fluids from communicating between inside and outside the collar 120, the slots 130 are filled with non-conducting materials that are resistant to fluid flow but transparent to electromagnetic energy. Non-limiting examples of non-conducting materials are PEEK, PEK, epoxy, and ceramics. Refer to FIG. 2 for a visual illustration of the nonconducting material 220. The length and width of the slots can vary according to the telemetry or electronic needs of transmitting data. Refer to FIG. 8 for nonlimiting examples of slot width.

Figure 2A:
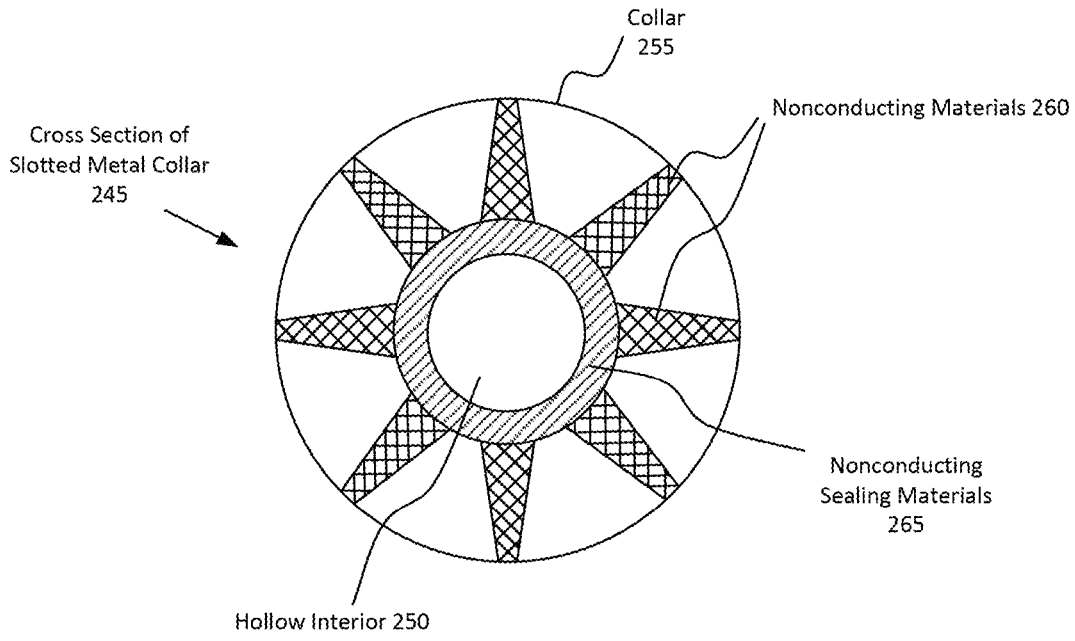
FIG. 2A is a diagram illustrating a slotted metal collar according to an exemplary embodiment.

An exemplary cross section of a slotted metal collar 245 is show in FIG. 2A with a collar 255, nonconducting materials 260, a hollow interior 250, and nonconducting sealing materials 265. For stability of the non-conducting materials 220 filling the slots 130, the slots 130 may be shaped with larger openings on the inner diameter than on the outer diameters. The length and width of the slots can vary according to the telemetry or electronic needs of transmitting data. Refer to FIG. 8 for nonlimiting examples of slot width.

Figure 2B:
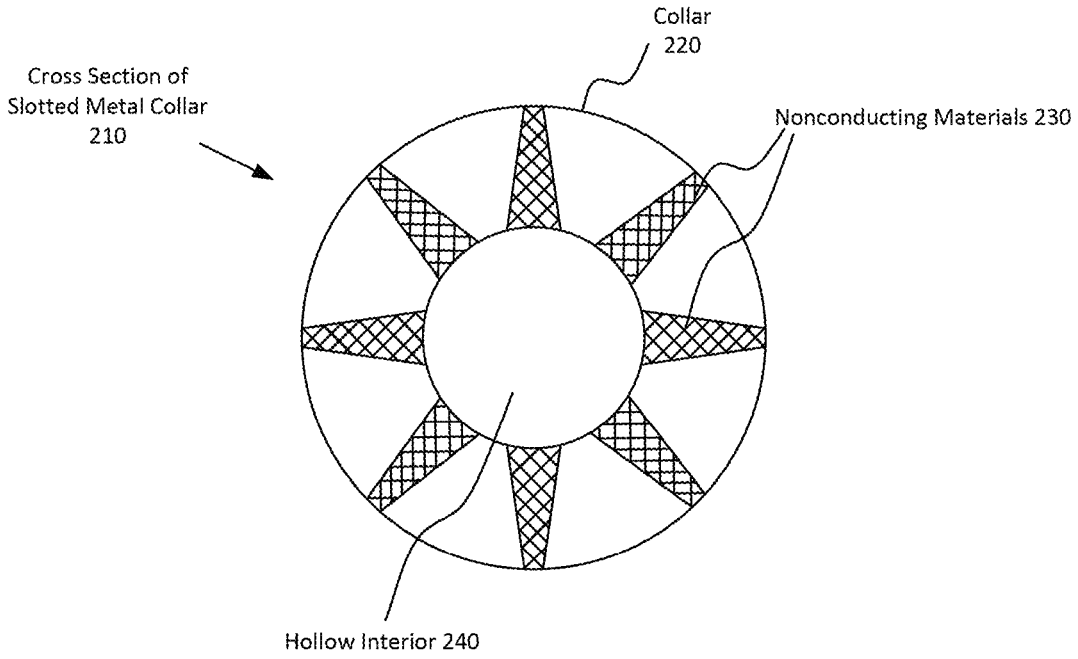
FIG. 2B is a diagram illustrating a slotted metal collar according to an exemplary embodiment.

An exemplary cross section of a slotted collar 210 is shown in FIG. 2B with a collar 220, nonconducting materials 230, hollow interior 240. In normal drilling operations, mud is pumped through the inner hollow of a drill string and circulated back through the annulus of the drill string to transport cuttings to the surface. The mud pressure in the inner hollow may be higher than the annulus mud pressure. For stability of the non-conducting materials 220 filling the slots 130, the slots 130 may be shaped with larger openings on the inner diameter than on the outer diameters. The length and width of the slots can vary according to the telemetry or electronic needs of transmitting data. Refer to FIG. 8 for nonlimiting examples of slot width.

Figure 3:
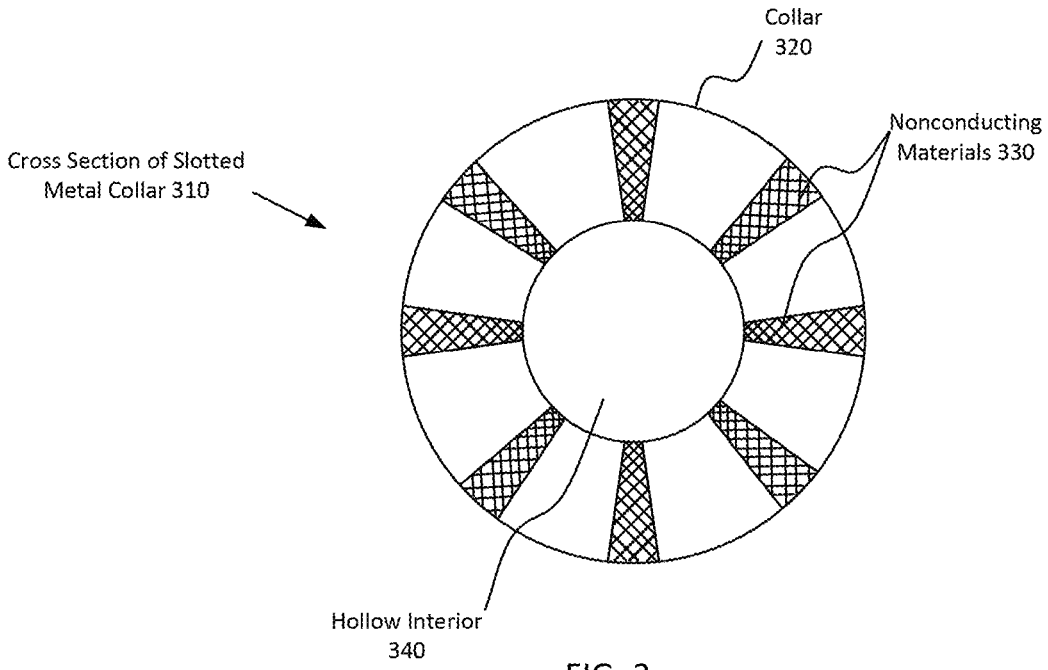
FIG. 3 is a diagram illustrating a slotted metal collar according to an exemplary embodiment.

Another exemplary cross section of a slotted collar 310 is show in FIG. 3 with a collar 320, nonconducting materials 330, and a hollow interior 340. In other drilling operations where the hollow mud pressure is lower than the annulus mud pressure, the slots 130 may be shaped with larger openings on the outer diameter than on the inner diameters. The length and width of the slots can vary according to the telemetry or electronic needs of transmitting data. Refer to FIG. 8 for nonlimiting examples of slot width.

Figure 4:
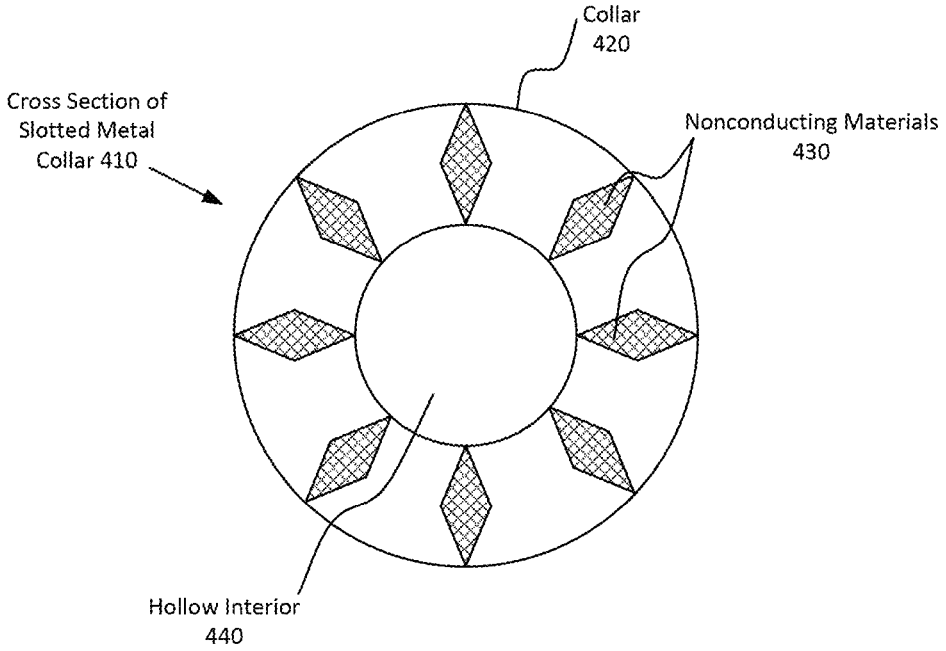
FIG. 4 is a diagram illustrating a slotted metal collar according to an exemplary embodiment.

FIG. 4 illustrates a cross section of another slotted metal collar 410 with a collar 420, nonconducting materials 430, and hollow interior 440. In this embodiments, the slots may be shaped to have larger cross sections inside the collar 420 wall than either on the outer diameter or on the inner diameter. The length and width of the slots can vary according to the telemetry or electronic needs of transmitting data. Refer to FIG. 8 for nonlimiting examples of slot width.

Figure 5A:
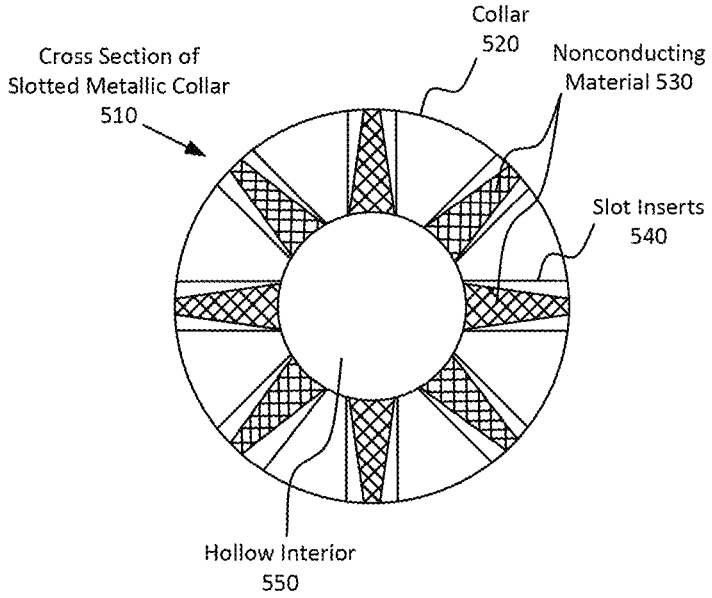
FIG. 5A is a diagram illustrating a slotted metal collar according to an exemplary embodiment.
Figure 5B:
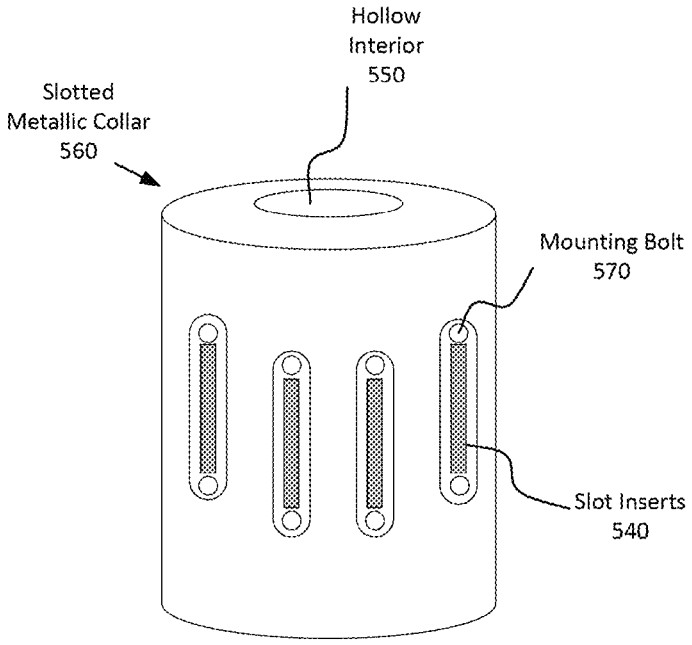
FIG. 5B is a diagram illustrating a slotted metal collar according to an exemplary embodiment.

FIG. 5A illustrates a cross section of a slotted metallic collar 510 with a collar 520, nonconducting material 530, slot inserts 540, and a hollow interior 550. In this embodiment, the slots may be filled with replaceable slot inserts 540. Each of the replaceable slot inserts 540 is made of, e.g., some sort of metal containing a hollow in the center. The replaceable slot inserts 540 extend from the outer diameter of the drill collar to the inner diameter of the drill collar. The hollow in each of the replaceable slot inserts 540 extends from the outer surface of the replaceable slot insert to the inner surface of the replaceable slot insert. The hollow may be filled with nonconducting materials 530 such as PEEK, PEK, epoxy, and ceramics. FIG. 5B illustrates a slotted metallic collar 560. The replaceable slot inserts 540 may be secured to the drill collar by mounting bolts 570 or by some other attachment means. The length and width of the slots can vary according to the telemetry or electronic needs of transmitting data. Refer to FIG. 8 for nonlimiting examples of slot width.

Figure 6:
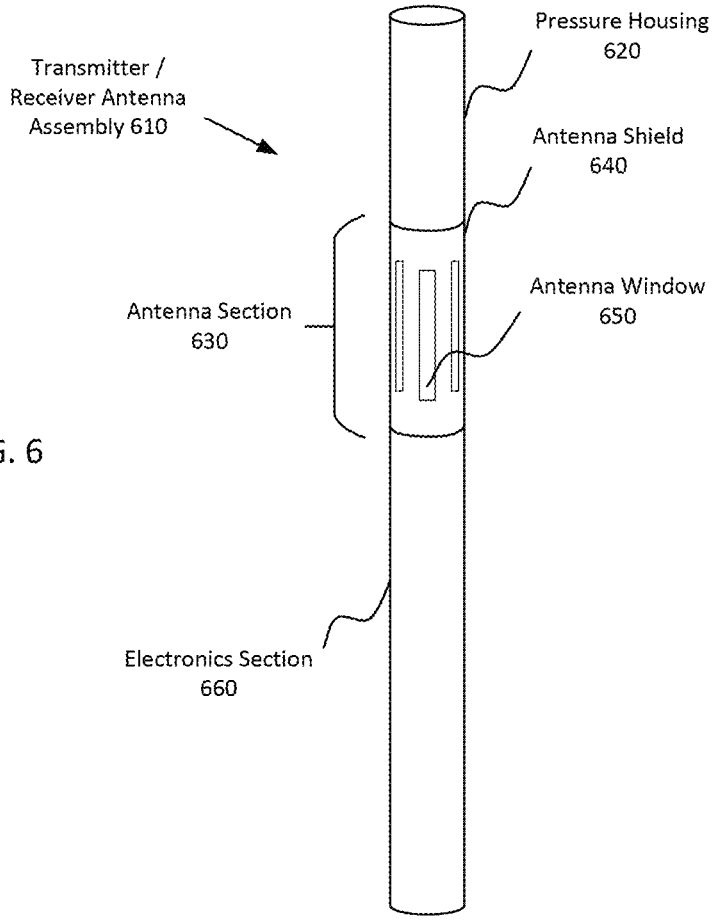
FIG. 6 is a diagram illustrating a probe-based transmission antenna assembly according to an exemplary embodiment.

FIG. 6 illustrates a probe based transmission or receiver antenna assembly. It consists of an antenna section 630, an electronics section 660, and a pressure housing 620 to protect the interior of the assembly from exposure to drilling fluids. The antenna section 630 consists of an antenna shield 640, one or more antenna windows 650 cut into the antenna shield to allow electromagnetic energy to pass through, and a coil winding underneath the antenna shield 640. The antenna shield 640 may be made of metal, e.g., steel or copper, or other materials that can survive drilling operations. The windows 650 in the antenna shield 640 may be filled with nonconducting materials such PEEK, PEK, epoxy, and ceramics. In this embodiments and other embodiments described herein, the antenna can both receive and transmit information. The information includes without limitation data and information retrieved or received by one or more sensors. For example, a drill string can include one or more sensors that can retrieve data related to seismic activity, water or moisture levels, radiation, pollution, hydrocarbon levels, salinity, and other information.

Figure 7A:
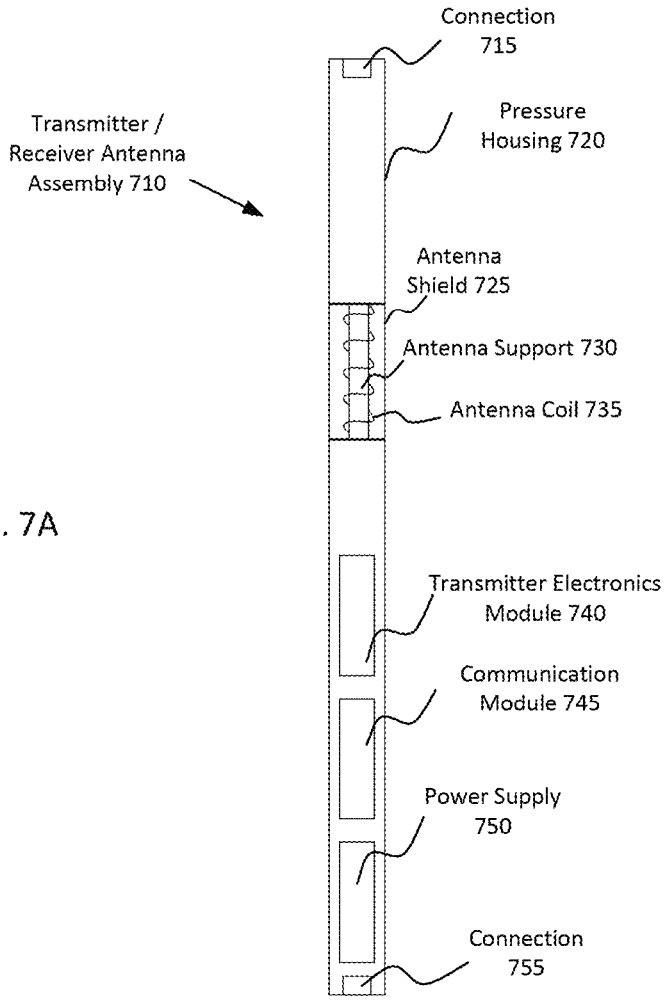
FIG. 7A is a diagram illustrating a transmission antenna assembly according to an exemplary embodiment. Probe based transmission antenna assembly

FIG. 7A illustrates a probe-based transmitter/receiver antenna assembly 710. The antenna coil 735 is wound around an antenna support 730 that can be either metal or a nonconducting material. In the illustration, the coil 735 is wound such that its magnetic moment points in the longitudinal direction of the antenna assembly. The electronics section may include a power supply section 750, a data communication section 745, and a transmission electronics section 740. The power supply section 750 may consist of one or more supplies that supply power to the communication and/or the transmission electronics section 740. The transmission electronics section 740 can transmit data received from one or more other antennae and/or one or more other sensors. The data communication section 745 may send or receive data from an external unit and/or one or more other antennae e.g., a measurement-while-drilling control unit or data telemetry unit. The transmission electronics section creates an electromagnetic waveform, encodes the waveform using a pre-selected keying method, amplifies the waveform, and drives the waveform to the transmission antenna coil 735. Examples of keying methods are frequency-shift keying (FSK), phase-shift keying (PSK), and amplitude-shift keying (ASK). The transmitting antenna radiates the electromagnetic energy outward into the surrounding rock formations through the antenna windows 650 on the transmitter/receiver antenna assembly 610 and the slotted drill collar. On the reception end, a receiving antenna assembly receives the radiated electromagnetic energy, conditions it, amplifies it, and decodes it to recover the data transmitted.

Figure 7B:
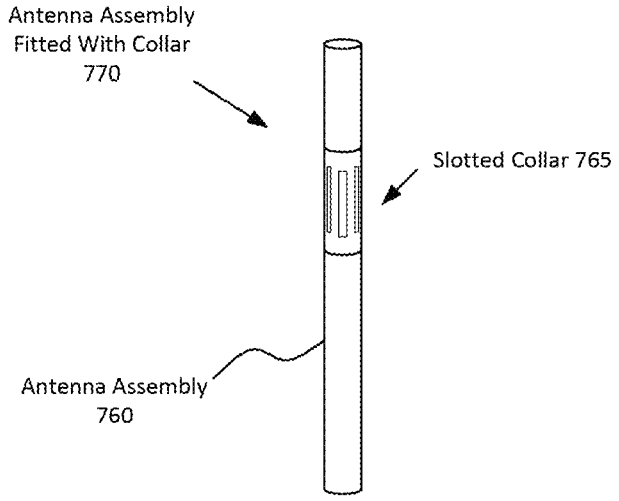
FIG. 7B is a diagram illustrating a transmission antenna assembly according to an exemplary embodiment.

FIG. 7B illustrates a probe based transmitter or receiver antenna assembly 760 with a slotted collar 765. The antenna assembly 760 is inserted into the slotted collar 765 aligning the slots of the collar with the antenna of the probe based transmitter/receiver.

Figure 7C:
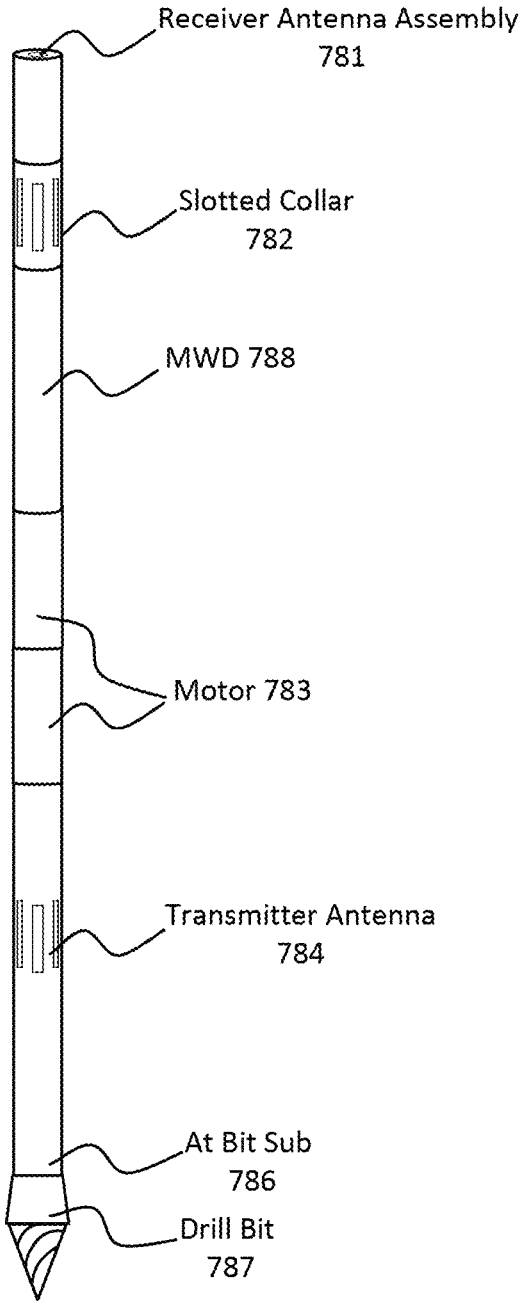
FIG. 7C is a diagram illustrating a transmission antenna assembly according to an exemplary embodiment.

FIG. 7C illustrates a drill string with a receiver antenna 781 fitted with a slotted metal collar 782, a motor 783, a MWD 788, a transmitter antenna 784 assembled on the wall of Atbit sub 786, and a drill bit 787. The MWD ("Measurement While Drilling") is designed to measure parameters such as the wellbore direction, drilling speed, temperature, pressure, and other parameters in real-time while the drilling process is ongoing. The MWD tool provides important information to the drilling team, which can help them make adjustments to the drilling process to ensure that the well is drilled accurately and efficiently. The MWD data can also be used to create a detailed picture of the subsurface formations being drilled, which is important for determining the location and characteristics of hydrocarbon reserves. The At-bit sub 786 has electronics to measure RPM, Continuous inclination, Azimuthal Gamma or Azimuthal Resistivity and process the data. It has transmitter electronics to send the data to using the transmitting antenna 784 to the receiver antenna 781. In one embodiment they are working as two way communication. The motor 783 can come in a variety of sizes and configurations, depending on the specific drilling requirements of the well. It can be designed to operate at different speeds, pressures, and torque levels, and may include features like adjustable bent housings to control the direction of the wellbore. The drill string is fully retrievable. In some embodiments, the transmitter antenna 784 is directly assembled on the wall of the At-Bit sub 786 so there is no need for a slotted collar.

FIG. 8 illustrates the graph 800 showing the chance that a receiving antenna assembly successfully decodes a received electromagnetic signal depends on signal-to-noise ratio. The signal-to-noise ratio depends on many factors. Among them are distance between the transmitting and the receiving antennas, mud resistivity, formation resistivity, and the amount of attenuation that a slotted drill collar has on the electromagnetic energy. The drill collar attenuation can be measured as a ratio of the magnetic field inside a slotted collar to that outside. If a slotted drill collar is used for transmission, the drill attenuation will be measured as a ratio of the magnetic field outside a slotted collar to that inside. The ratio will depend on the number of slots, the width and length of the slots, the thickness of the collar, and the materials that fill the slots. The magnetic fields inside and outside a slotted drill collar can be calculated using numerical models. An example of such calculations is shown FIG. 8. In the model, the collar outer diameter is 6.75 in. and its thickness is 1.8 in. The model contains 8 slots each being 0.25 in. wide. For slots of 2 in. long, only about 2.3% of the magnetic field can pass through the slotted drill collar. At 4 in. length, the percentage increases to about 22%. At 6 in. length, the percentage increases to about 47%. The minimum slot length that can be used will depend on the lowest SNR that allows successful data decoding. Any of the assemblies or collars described herein can be manufactured with the number of slots and the length of slots necessary to maximize reception of signals.

Figure 9:
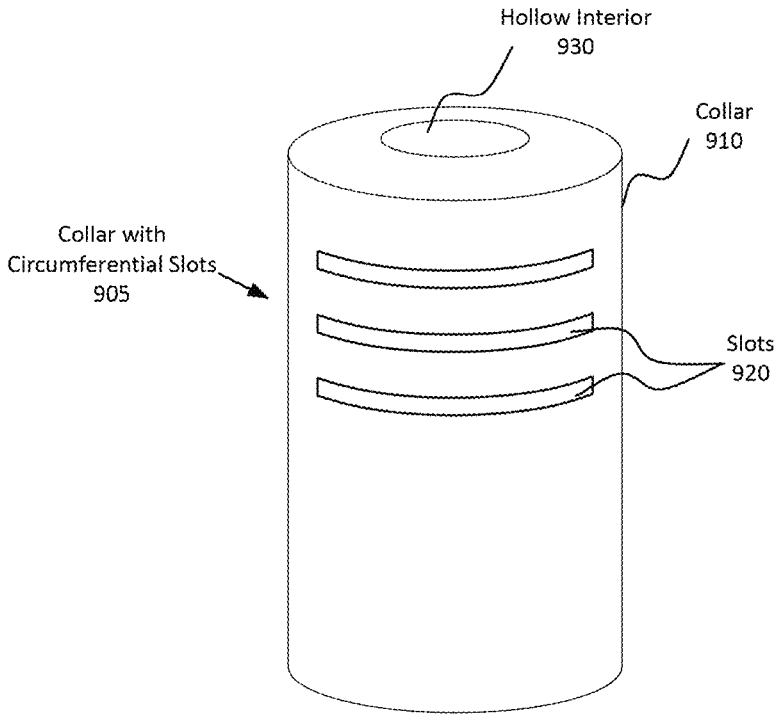
FIG. 9 is a diagram illustrating a collar with circumferential slots according to an exemplary embodiment.

FIG. 9 illustrates a collar with circumferential slots 905. The collar has a hollow interior 930. Alternative methods exist in constructing a slotted drill collar or transmission or reception antenna assembly. For instance, a drill collar 910 may be slotted with the slots 920 oriented in a circumferential direction of the collar. Accordingly, the antenna windows on the transmission or reception antenna assembly will also be oriented in a circumferential direction of the collar. The length and width of the slots can vary according to the telemetry or electronic needs of transmitting data. Refer to FIG. 8 for nonlimiting examples of slot width.

Figure 10A:
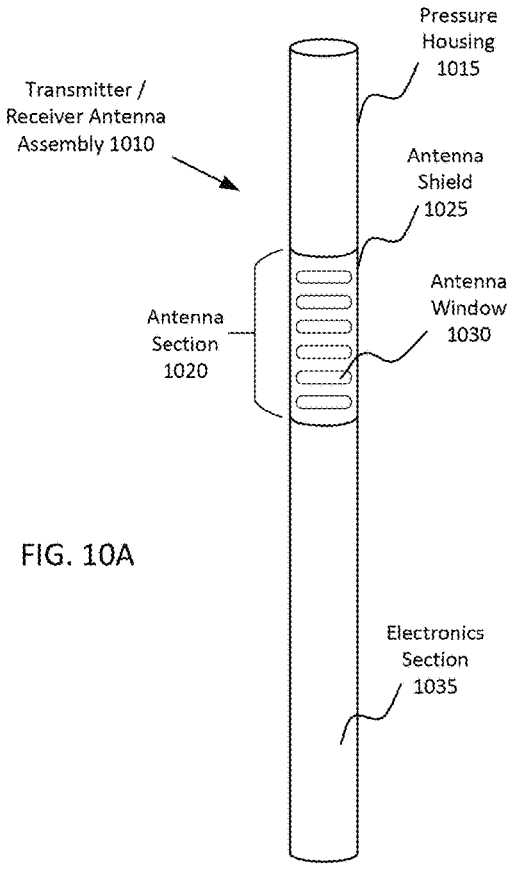
FIG. 10A illustrates a transmission antenna assembly according to an exemplary embodiment.
Figure 10B:
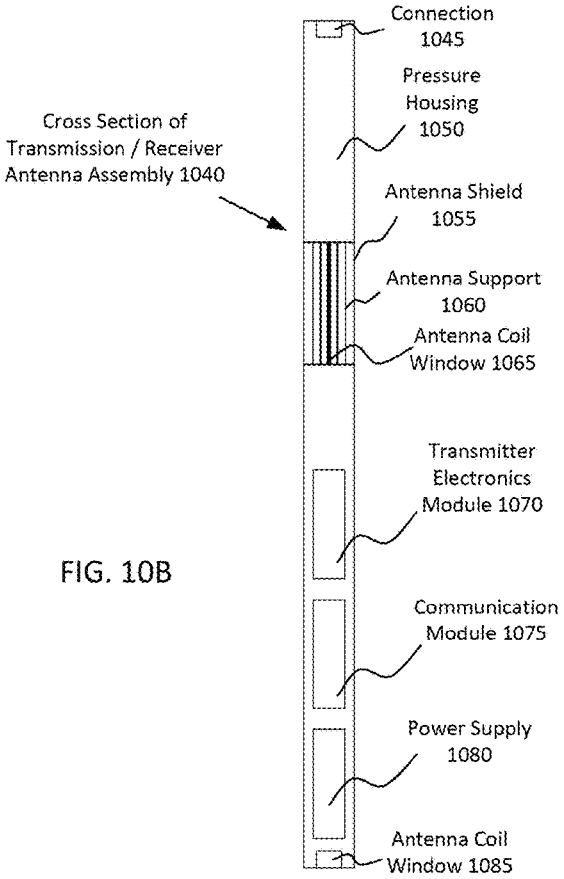
FIG. 10B illustrates a transmission antenna assembly according to an exemplary embodiment.

For maximum transmission or reception of electromagnetic energy, the transmission or reception antenna in the antenna assembly is wound such that its magnetic moment points to a direction orthogonal to the longitudinal direction of the assembly. FIG. 10A illustrates a probe-based transmitter/receiver assembly antenna assembly 1010 which can include without limitation a pressure housing 1015, antenna section 1020 containing antenna shield 1025 and antenna window 1030, and electronics section 1035. FIG. 10B illustrates a cross section of a transmission antenna assembly 1040 which can include without limitation a connection 1045, a pressure housing 1050, an antenna shield 1055, an antenna support 1060, an antenna coil window 1065, a transmitter electronics module 1070, a communication module 1075, a power supply 1080, and an antenna coil 1085. In this embodiments and other embodiments described herein, the antenna can both receive and transmit information. The information includes without limitation data and information retrieved or received by one or more sensors. For example, a drill string can include one or more sensors that can retrieve data related to seismic activity, water or moisture levels, radiation, pollution, hydrocarbon levels, salinity, and other information.

In some aspects, the techniques described herein relate to a system for transmitting and receiving data across a bottom hole assembly, the system including: an axial transmission antenna assembly including: an upper end including an upper end connection; a lower end including a lower end connection, wherein the upper end connection and the lower end connection are configured to removably attach with at least one other axial transmission antenna assembly; a pressure housing; an antenna housing further including: an antenna shield surrounding an antenna support and an antenna coil; an electronics section further including: a transmitter electronics module; a communication module; a power supply configured to power the antenna, transmitter electronics module, and the communication module; a drill collar configured to removably attach to the axial transmission antenna assembly, wherein the collar includes: a hollow interior; and an exterior including one or more slots configured to house one or more nonconducting materials.

In some aspects, the techniques described herein relate to a system, wherein the antenna in the antenna assembly is wound such that a magnetic moment points to a direction orthogonal to a longitudinal direction of the assembly.

In some aspects, the techniques described herein relate to a system, wherein the drill collar includes an inner diameter and an outer diameter, wherein the slots may be oriented along a longitudinal direction of the drill collar and extend from the outer diameter of the collar to the inner diameter of the drill collar.

In some aspects, the techniques described herein relate to a system, wherein slots are shaped with larger openings on the outer diameter than on the inner diameters.

In some aspects, the techniques described herein relate to a system, slots may be shaped to have larger cross sections inside the collar wall than either on the outer diameter or on the inner diameter.

In some aspects, the techniques described herein relate to a system, wherein the nonconducting materials are resistant to fluid flow but transparent to electromagnetic energy.

In some aspects, the techniques described herein relate to a system, wherein the nonconducting materials include at least one selected from the group of polyetheretherketone (PEEK), polyether ketone (PEK), epoxy, or ceramics.

In some aspects, the techniques described herein relate to a system, wherein the one or more slots may be filled with one or more replaceable slot inserts.

In some aspects, the techniques described herein relate to a system, wherein the one or more replaceable slot inserts extend from the outer diameter of the drill collar to the inner diameter of the drill collar.

In some aspects, the techniques described herein relate to a system, wherein the one or more replaceable slot inserts is secured to the drill collar by one or more mounting bolts.

In some aspects, the techniques described herein relate to a system for transmitting data across a bottom hole assembly, the system including: a first drill collar configured to be attached to a first antenna assembly, wherein the first drill collar further includes a first hollow interior a second exterior including one or more slots configured to house one or more nonconducting materials; and a second drill collar configured to be attached to a second antenna assembly, wherein the second drill further includes a second hollow interior and a second exterior including one or more slots configured to house one or more nonconducting materials, In some aspects, the techniques described herein relate to a system, wherein the nonconducting materials include at least one selected from the group of polyetheretherketone (PEEK), polyether ketone (PEK), epoxy, or ceramics.

In some aspects, the techniques described herein relate to a system, wherein the system further includes an at bit subassembly further including a transmitter antenna, wherein the at bit assembly is configured to transmit drill bit information to at least the first and second antenna assemblies.

In some aspects, the techniques described herein relate to a system, wherein the system further includes a motor between the first antenna assembly and the second antenna assembly.

In some aspects, the techniques described herein relate to a system, wherein the first and second antenna assemblies communicate via electro magnetic waves.

In some aspects, the techniques described herein relate to a system, wherein each of the first and second antenna assemblies are capable of at least transmitting and receiving information.

In some aspects, the techniques described herein relate to a system, wherein the first and second drill collars each include: a hollow interior; and an exterior including one or more slots configured to house one or more nonconducting materials.

In some aspects, the techniques described herein relate to a system, wherein the one or more slots are oriented in the circumferential direction of the first and second drill collars.

In some aspects, the techniques described herein relate to a system, wherein the slots may be oriented along a longitudinal direction of the first and second drill collars and extend from the outer diameter of the drill collars to the inner diameter of the drill collars.

In some aspects, the techniques described herein relate to a device for sending and receiving communications across a down hole assembly, the device including: a collar configured to allow insertion of a first antenna assembly, the collar including one or more slots; and one or more nonconducting materials located in the one or more slots, wherein the collar is configured to facilitate a transmission of one or more electrical voltages from the first antenna assembly to a second antenna assembly.

In some aspects, the techniques described herein relate to a device for sending and receiving communications across a down hole assembly, the device including: a collar configured to allow insertion of probe based receiver/transmitter assembly, the collar including one or more slots; one or more nonconducting materials located in the one or more slots, wherein the collar is configured to facilitate a transmitting or receiving of one or more electrical voltages from the first antenna assembly to a second antenna assembly.

In the disclosure, various embodiments have been described with references to the accompanying drawings. It may, however, be evident that various modifications and changes may be made thereto, and additional embodiments may be implemented, without departing from the broader scope of the disclosure as set forth in the claims that follow. The disclosure and drawings are accordingly to be regarded in an illustrative rather than restrictive sense.

The disclosure is not to be limited in terms of the particular embodiments described herein, which are intended as illustrations of various aspects. Many modifications and variations can be made without departing from its spirit and scope. Functionally equivalent systems, processes, and apparatuses within the scope of the disclosure, in addition to those enumerated herein, may be apparent from the representative descriptions herein. Such modifications and variations are intended to fall within the scope of the appended claims. The disclosure is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the disclosure. The embodiments described should be recognized as capable of implementation separately, or in combination, with other embodiments from the description of the embodiments. A person of ordinary skill in the art reviewing the description of embodiments should be able to learn and understand the different described aspects of the disclosure. The description of embodiments should facilitate understanding of the disclosure to such an extent that other implementations, not specifically covered but within the knowledge of a person of skill in the art having read the description of embodiments, would be understood to be consistent with an application of the disclosure.

What is claimed is:

1. A system for transmitting data across a bottom hole assembly, the system comprising:

a first drill collar configured to be attached to a first antenna assembly, wherein the first drill collar comprises a first hollow interior and a first exterior comprising one or more first slots configured to house one or more nonconducting materials; and a second drill collar configured to be attached to a second antenna assembly, wherein the second drill collar comprises a second hollow interior and a second exterior comprising one or more second slots configured to house the one or more nonconducting materials;

wherein the one or more first and second slots configured to house the one or more nonconducting materials on the first drill collar, and the second drill collar, wherein the one or more first slots comprise one or more first replaceable metal slot inserts containing a first hollow in a center of a first slotted metal collar, and the one or more second slots comprise one or more second replaceable metal slot inserts containing a second hollow in a center of a second slotted metal collar, and wherein the one or more first replaceable metal slot inserts extend from an outer diameter of the first drill collar to an inner diameter of the first drill collar and the one or more second replaceable metal slot inserts extend from an outer diameter of the second drill collar to an inner diameter of the second drill collar, wherein the first hollow in the one or more first replaceable metal slot inserts extends from an outer surface of the one or more first replaceable slot inserts to an inner surface of the one or more first replaceable slot inserts and the second hollow in the one or more second replaceable metal slot inserts extends from an outer surface of the one or more second replaceable slot inserts to an inner surface of the one or more second replaceable slot inserts, and wherein the first hollow and the second hollow are configured to house the one or more nonconducting materials.

2. The system of claim 1, wherein the nonconducting materials of the first drill collar and the second drill collar comprise at least one nonconducting material selected from a group of polyetheretherketone (PEEK), polyether ketone (PEK), epoxy, or ceramics.

3. The system of claim 1, wherein the system further comprises an at bit subassembly further comprising a transmitter antenna, wherein the at bit assembly is configured to transmit drill bit information to at least the first and second antenna assemblies.

4. The system of claim 3, wherein the system further comprises a motor between the first antenna assembly and the second antenna assembly.

5. The system of claim 4, wherein the first and second antenna assemblies communicate via electromagnetic waves.

6. The system of claim 5, wherein each of the first and second antenna assemblies are configured of at least transmitting and receiving the drill bit information.

7. The system of claim 1, wherein the one or more first and second slots in the exterior of the first and second drill collars are oriented in a circumferential direction of the first and second drill collars.

8. The system of claim 1, wherein the one or more first and second slots of the first and second drill collars are oriented along a longitudinal direction of the first and second drill collars and extend from the outer diameter of the first and second drill collars to the inner diameter of the first and second drill collars.

9. A device for sending and receiving communications across a down hole assembly, the device comprising:

a collar configured to allow insertion of a first antenna assembly, the collar comprises a first hollow interior and an exterior comprising one or more slots; and one or more nonconducting materials located in the one or more slots, wherein the collar is configured to facilitate a transmission of one or more electrical voltages from the first antenna assembly to a second antenna assembly;

wherein the one or more slots comprise one or more replaceable metal slot inserts containing a hollow in a center of a slotted metal collar and wherein the one or more replaceable metal slot inserts extend from an outer diameter of the drill collar to an inner diameter of the drill collar and wherein the hollow in the one or more replaceable metal slot inserts extends from an outer surface of the one or more replaceable slot inserts to an inner surface of the one or more replaceable slot inserts and wherein the hollow is configured to house the one or more nonconducting materials located in the one or more slots.

* * * * *